United States Patent [19]

Rhodes

[11] 4,385,408

[45] May 31, 1983

[54] SANITARY CUSHIONING DEVICE FOR SINK BOWL EDGES

[76] Inventor: Joanne Rhodes, 817 Cybus Way, Southampton, Pa. 18966

[21] Appl. No.: 198,021

[22] Filed: Oct. 17, 1980

[51] Int. Cl.[3] ..... A47K 3/022; A47K 3/12

[52] U.S. Cl. ..... 4/523; 4/515; 4/579; 4/519; 4/575

[58] Field of Search ..... 4/515, 201, 519, 516, 4/517, 518, 523, 530, 575, 621, 638, 661, 579, 578; 297/397, 399

[56] References Cited

U.S. PATENT DOCUMENTS

| | | | |
|---|---|---|---|
| 1,805,622 | 5/1931 | Goodwin | 4/579 |
| 2,161,590 | 6/1939 | Rickard | 4/523 |
| 2,261,476 | 11/1941 | Kiefer | 4/519 |
| 2,494,957 | 1/1950 | Morgan | 4/523 X |
| 2,948,903 | 8/1960 | Gilmer | 4/523 |
| 3,029,107 | 4/1962 | Myers | 297/399 |
| 4,106,133 | 8/1978 | Roberts | 4/201 X |
| 4,114,948 | 9/1978 | Perkey | 297/397 |

FOREIGN PATENT DOCUMENTS

| | | | |
|---|---|---|---|
| 82201 | 11/1956 | Denmark | 297/397 |
| 1335826 | 7/1963 | France | 297/397 |

*Primary Examiner*—Henry K. Artis

*Attorney, Agent, or Firm*—Frederick A. Zoda; John J. Kane; Albert Sperry

[57] ABSTRACT

A sanitary cushioning device for sink bowl edges is disclosed including a platform having a first and a second leg extending downwardly approximately perpendicular with respect thereto to define a slot therebelow. The slot is adapted to receive a sink bowl edge such as often found in a beauty parlor or haircutting salon. The device cushions the edge of the sink such that when a customer places his head in the sink bowl for washing the back of his neck will be cushioned for comfort. The device is usable with a great variety of different types of sink configurations due to the thick, soft resilient nature of the material. A water repellent covering is detachably securable onto the device to prevent water from contacting the foam rubber material. The device is held in place and the water resistant covering is held in place on the sink edge by the inwardly directed bias of the resilient foam rubber downwardly extending legs.

9 Claims, 5 Drawing Figures

SANITARY CUSHIONING DEVICE FOR SINK BOWL EDGES

BACKGROUND OF THE INVENTION

1. Field of the Invention

In haircutting salons for both men and woman it is common for the attendant to wash the hair of a customer prior to each haircutting. Sinks are normally specially configured with a slot or horizontally extending forward edge such that when the chair of the client is tilted backwardly his head may be extended into the sink for convenience in washing. A problem arises due to the material from which most sinks are made, namely, porcelain which is very hard and tends to be uncomforable when the customer leans on the sink during washing. The present invention provides a novel means for making this surface soft. Also this invention is particularly usable when a permanent is being done since the rollers can be somewhat hard when positioned between the neck of the user and the porcelain sink. The device of the present invention cushions these rollers and allows comfort during the processing of a permanent.

Sanitary requirements in the beauty parlor field are extensive and it is necessary to be sure that each of these devices is completely sealed from contact with water. In this manner the water repellent cover is disclosed as an aspect of the present invention. The covering must be adaptable to be removed from the cushioning device after each usage in accordance with normal state beauty parlor licensing standards. The present invention provides a novel means for easily removing of a water repellent covering after each usage of the device. The ease of removal and replacement of this covering is an important aspect of the present invention. The covering is held in place by the bias exerted against the sink by the first and second downwardly extending legs of the cushioning device. In this manner a simple and convenient device is disclosed which completely cushions the neck of the user, seals the device from contact with water, and allows simple and quick replacement of the water-resistent coating after each usage thereof.

2. Description of the Prior Art

Devices have been patented dealing with this general purpose including U.S. Pat. No. 2,948,903. However, none of the devices in the prior art or patented heretofore show a device with an easily detachable covering means used in association with a thick foam rubber flexibly resilient sink edge cushioning device.

SUMMARY OF THE INVENTION

The present invention provides a sanitary cushioning device particularly usable with the edges of sink bowls in beauty parlors and haircutting salons. The device includes a platform means which is adapted to extend horizontally over the upper edge of such a sink bowl wherein the platform is of a flexibly resilient material such as foam rubber. The platform should include a lower platform surface which is adapted to abut the upper edge of the sink bowl located therebelow.

A first leg means is adapted to be fixedly secured with respect to one end of the platform means to extend downwardly approximately perpendicularly therefrom in such a manner as to be positioned against the inner side of a sink bowl edge. This first leg means should preferably be of a flexibly resilient material such as foam rubber or sponge material and should define an inner first surface which is adapted to abut the inner portion of the sink bowl and exert a bias thereagainst. This bias tends to hold the cushioning device in place as well as the covering means extending thereover.

The device should further include another leg means which is fixedly secured with respect to the end of the platform means opposite from the location of securement of the first leg means. This second leg means should also extend generally perpendicularly downward therefrom and be generally parallel with respect to the downwardly extending inner first surface of the first leg means. The second leg means is also of a foam rubber or sponge-like material. The second leg means should include an inner second surface which is adapted to abut the outer portion than the normal width of distance of a sink edge such that the inner first surface is biased against the inner portion of the sink bowl as simultaneously with the inner second surface being biased against the outer edge of the sink bowl edge. In this manner the cushioning device will be retained more easily in place on the sink bowl edge. The inner first surface and the inner second surface and the lower platform surface cooperate to define a slot means therebetween which is adapted to receive a sink bowl edge therein. This slot means also defines two open side areas therein throughwhich the sides of the edge of the sink can protrude.

A covering means of a water-resistent material is adapted to extend into the slot means between the sink bowl edge and the lower platform surface, the inner first surface and the inner second surface. In this manner water will be prevented from passing from the sink outwardly into the surrounding portions of the room and also the device itself will be insulated from wetting contact with water. It is undesirable for the flexible resilient material of the platform means and the first and second leg means to be contacted with water.

Preferably the covering means may be of a plastic material and may be configured as a simple bag member. However, the covering means should include two upper flaps which extend into the open side area between the lower platform surface and the top edge of the sink bowl. The covering member also should include a set of side flaps which extend through the open side areas between the inner first surface and the inner portion of a sink bowl edge to be held in place by the bias exerted therebetween. Furthermore, the covering means will include a second set of side flaps extending through the open side areas between the second surface and the outer portion of the sink bowl to be held in place by the bias therebetween. Furthermore, the covering means includes a first lower flap and a second lower flap which extend vertically upward into the slot means between the inner first surface the inner second surface and the inner and outer portion of the sink bowl edge to thereby be held in place by the exerted bias therebetween. In this manner all of these flaps will be held in place by the tension between the downwardly extending legs and in particular the inner surfaces thereof and the sink bowl edges itself.

It is an object of the present invention to provide a sanitary cushion device for placement on sink bowl edges which eliminates wetting of the cushioning device.

It is an object of the present invention to provide a sanitary cushioning device for sink bowl edges which increases comfort of persons receiving hair treatment.

It is an object of the present invention to provide a sanitary cushioning device for sink bowl edges which is particularly usable for those persons receiving permanents.

It is an object of the present invention to provide a sanitary cushioning device for sink bowl edges which includes a water repellent covering means thereover to prevent wetting of the foam rubber material of the cushioning device.

It is an object of the present invention to provide a sanitary cushioning device for sink bowl edges which includes a covering means which is detachably securable with respect to the cushioning device itself merely by removal of the cushioning device off of the sink edge.

It is an object of the present invention to provide a sanitary cushioning device including a covering means which is not bonded or otherwise permanently secured with respect to the cushioning portion of the device.

It is an object of the present invention to provide a sanitary cushioning device for sink bowl edges which is usable with a great variety of different configurations of sink bowl edges.

It is an object of the present invention to provide a sanitary cushioning device for sink bowl edges which itself is held in place and which holds a water repellent covering in place merely by means of a bias exerted inwardly against the sink edge by two downwardly legs of the device.

It is an object of the present invention to provide a sanitary cushioning device for sink bowl edges which minimizes the escape of water out of the bowl into the surrounding environment and onto the floor.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
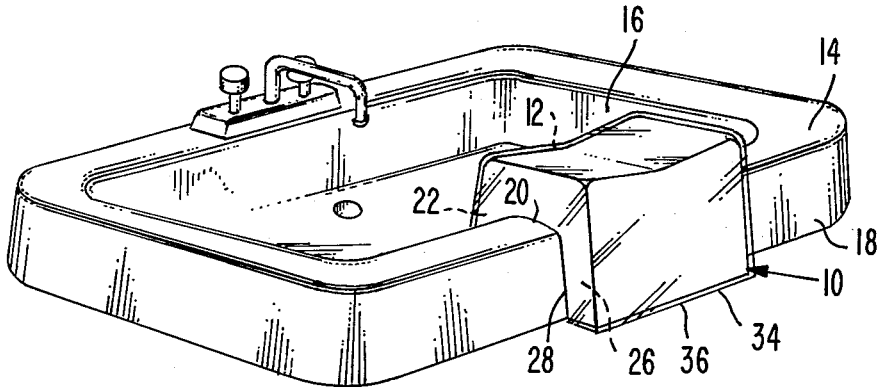
FIG. 1 is a perspective view showing an embodiment of the sanitary cushioning device of the present invention in place on a sink bowl edge.
Figure 2:
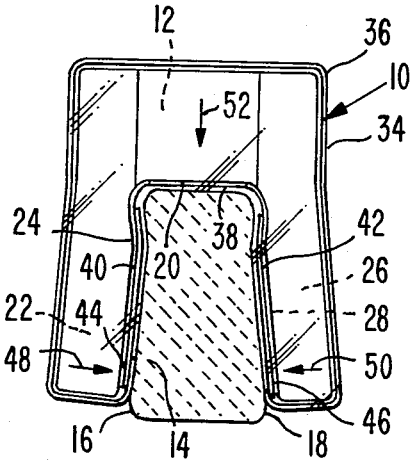
FIG. 2 is a cross-sectional view of an embodiment of a sanitary cushioning device of the present invention shown in place on a sink bowl edge.
Figure 3:
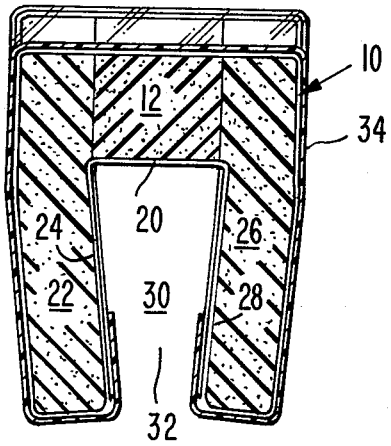
FIG. 3 is a cross-sectional view of an embodiment of the sanitary cushioning device of the present invention shown immediately prior to placement upon a sink bowl edge.
Figure 4:
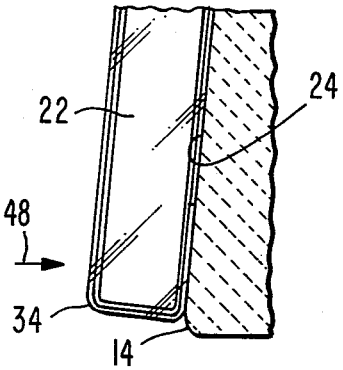
FIG. 4 is a close-up of the area of the embodiment shown in FIG. 2 showing the inwardly directed bias exerted by an embodiment of a leg member of the present invention against an embodiment of the covering member; and, FIG. 5 is a cross-section of the configuration shown in FIG. 3 along lines 3—3.
Figure 5:
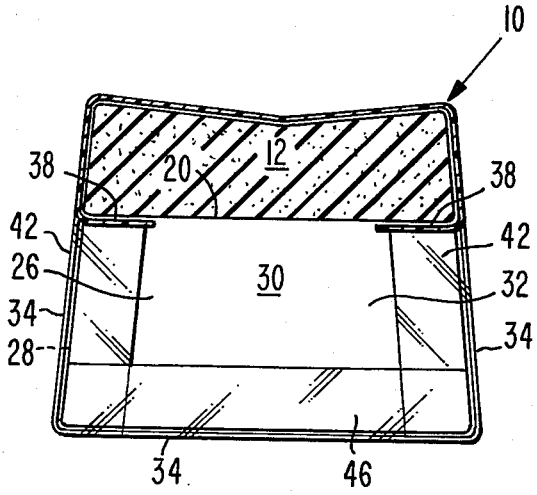

The present invention provides a sanitary cushioning device 10 which is particularly usable for attachment to the sink edge 14 of a standardly configured sink in a beauty parlor or haircutting salon. The purpose of this device is to cushion the neck of the customer against the sink during washing and permanent processes.

To achieve this cushioning a platform means 12 generally extends across the top portion of the sink edge 14. This platform means 12 is preferably of a soft, pliable thick material such as sponge rubber, foam rubber or other similar material. A lower platform surface 20 thereof is in contact with the top surface of the sink. The downwardly exerted gravitational force as well as the downwardly exerted force by the weight of the head and neck of the user causes a firm securement between the lower platform surface 20 and the top edge of the sink 14.

The device 10 of the present invention includes a first leg means 22 and a second leg means 26 extending downwardly from the lower platform surface 20 of the platform means 12. Preferably each of these legs extends downwardly generally parallel with respect to one another. The first leg means defines an inner first surface 24 and a second leg means defines an inner second surface 28 such that these two surfaces are spaced apart from one another at a distance somewhat less than the depth of an average sink. The inner first surface 24 is adapted to contact the inner portion 16 of the sink 14. The inner second surface 28 is adapted to abut and contact the outer portion 18 of the sink edge 14. Therefore, the distance between the inner first surface 24 and the inner second surface 28 being somewhat less than the distance between the inner portion 16 and the outer portion 18 of a conventionally configured sink will cause a bias to be directed inwardly toward the sink edge from the first leg means 22 and the second leg means 26. This mutually exerted bias inwardly toward the sink edge 14 will cause the sanitary cushioning device 10 to be fixedly held in place. This securement is also facilitated by appreciation of the sponge or rubber-like aspect of the device from which the first leg means 22 and second leg means 26 are made. In this manner a simple device is provided which will adhere to a sink edge 14 during usage thereof and yet be easily removable therefrom.

The inner first surface 24 and the inner second surface 28 in combination with the lower platform surface 20 defines a slot means 30 therebetween. This slot means 30 generally extends longitudinally to define two open side areas 32. In this manner the slot is adapted to receive the sink edge 14 therein such that the lateral sides of the sink edge 14 extend outwardly from the slot means 30 through the two open side areas 32.

To facilitate the sanitary aspects of the present invention a covering means 34 may be positioned over the entire configuration of the first leg means 22, the second leg means 26 and the platform means 12. This covering means is preferably of a water repellent or water resistent material in such a manner as to keep the cushioning portion of the device 10 free from contact with moisture. The covering means 34 may take the form of a plastic bag member 36.

Regardless of the actual configuration of the covering means 34 it should include portions thereof identifiable as upper flaps 38, a first set of side flaps 40, a second set of side flaps 42, a first lower flaps 44 and a second lower flaps 46.

The upper flaps 38 are adapted to extend through the open side areas 32 between the lower platform surface 20 and the top edge of the sink bowl 14. The first set of side flaps 40 is adapted to extend through the open side areas 32 between the inner first surface 24 and the inner portion of sink bowl edge 16 to thereby be held in place by the bias exerted therebetween. The second set of side flaps 42 on the other hand is adapted to extend through the open side areas 32 between the inner second surface 28 and the outer portion of a sink bowl edge 18 to thereby be held in place by the bias exerted therebetween. The first lower flaps 44 extend vertically upward into the slot means 30 between the inner first surface 24 and the inner portion 16 of a sink bowl edge to thereby be held in place by the bias exerted therebetween. Lastly, the second lower flaps 46 extend vertically upward into said slot means 30 between said inner second surface 28 and said outer portion 18 of a sink bowl edge to thereby be held in place by the bias exerted therebetween.

With this configuration a first bias indicated by arrow 48 is exerted against the inner portion of the sink edge 14 as a result of the resiliency of the material from which the first leg means 22 is made. Similarly, a second bias 50 is created in the opposite direction but also toward the sink edge 14 by the resiliency of the material from which the second leg means 26 is made. The gravitational bias 52 is exerted downwardly against the top edge of the sink. This is due to the downward pressure of the weight of the sanitary cushioning device 10 itself as well as the downwardly exerted bias of the head or neck of the user. With this configuration the flaps of the covering means 34 or the sides of the bag member 36 are retained between the sink edge and the interior walls of the slot means 30 in such a fashion as to both retain the sanitary cushioning device 10 in place as well as to hold the covering means 34 extending thereover. This configuration is easily detachable for replacement of the covering means 34 after each usage and for each new person.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A sanitary cushioning device for sink bowl edges comprising:

(a) a platform means adapted to extend horizontally over the upper edge of a standardly configured sink bowl edge, said platform means being of a flexible resilient material, said platform means including a lower platform surface adapted to abut the top edge of a sink bowl edge;

(b) a flexible first leg means fixedly secured with respect to one end of said platform means and extending downwardly therefrom to be positioned against the inner side of a sink bowl edge, said first leg means being of a flexible resilient material, said first leg means defining an inner first surface adapted to abut the inner portion of a sink bowl edge;

(c) a flexible second leg means fixedly secured with respect to the other end of said platform means and extending downwardly therefrom to be positioned against the other side of a sink bowl edge, said second leg means being of a flexible resilient material, said second leg means defining an inner second surface adapted to abut the outer portion of a sink bowl edge, said inner second surface being spatially disposed from said inner first surface at a distance less than the distance between an inner portion and an outer portion of a conventional sink bowl edge wherein said inner first surface is biased against the inner portion of a sink bowl edge and said inner second surface is biased against the outer portion of a sink bowl edge to detachably retain said cushioning device in place on said sink bowl edge, said inner first surface and said inner second surface and said lower platform surface defining a slot means therebetween adapted to detachably receive a sink bowl edge therein, said slot means defining the two open side areas therein, and (d) a removable covering means being of a water resistant material and extending into said slot means between the sink bowl edge and said lower platform surface, said inner first surface and said inner second surface to prevent water in the sink from wetting the flexible resilient material of said platform means and said first and second leg means.

2. The device as defined in claim 1 wherein said covering means comprises a bag member.

3. The device as defined in claim 2 wherein said bag member is of a plastic material.

4. The device as defined in claim 1 wherein sad cover member includes:

(a) two upper flaps extending through said open side area between said lower platform surface and the top edge of the sink bowl;

(b) a first set of side flaps extending through said open side areas between said inner first surface and the inner portion of a sink bowl edge to be held in place by the bias therebetween;

(c) a second set of side flaps extending through said open side areas between said inner second surface and the outer portion of a sink bowl edge to be held in place by the bias therebetween;

(d) a first lower flap extending vertically upward into said slot between said inner first surface and said inner portion of a sink bowl edge to be held in place by the bias therebetween; and (e) a second lower flap extending vertically upward into said slot means between said inner second surface and said outer portion of a sink bowl edge to be held in place by the bias therebetween.

5. The device as defined in claim 1 wherein said platform means, said first leg means and said second leg means are a single integral unit.

6. The device as defined in claim 1 wherein said platform means, said first leg means and said second leg means are of a foam rubber material.

7. The device as defined in claim 1 wherein said platform means, said first leg means and said second leg means are of a sponge-type material.

8. The device as defined in claim 1 wherein said inner first surface and said inner second surface extend downwardly from said lower platform surface parallel with respect to one another.

9. A sanitary cushioning device for sink bowl edges comprising:

(a) a platform means adapted to extend horizontally over the upper edge of a standardly configured sink bowl edge, said platform means being of a foam rubber material, said platform means including a lower platform surface adapted to abut the top edge of a sink bowl edge;

(b) a first leg means fixedly secured with respect to one end of said platform means and extending downwardly therefrom to be positioned against the inner side of a sink bowl edge, said first leg means being of a foam rubber material, said first leg means defining an inner first surface adapted to abut the inner portion of a sink bowl edge;

(c) a second leg means fixedly secured with respect to the other end of said platform means and extending perpendicularly downwardly therefrom parallel with respect to said first leg means to be positioned against the outer surface of a sink bowl edge, said second leg means being of a foam rubber material, said second leg means defining an inner second surface adapted to abut the outer portion of a sink bowl edge, said inner second surface being spatially disposed from said inner first surface at a distance less than the distance between an inner portion and an outer portion of a conventional sink bowl edge wherein said inner first surface is biased against said inner portion of the sink bowl edge and said inner second surface is biased against the outer portion of the sink bowl edge to detachably retain said cushioning device in place on said sink bowl edge, said inner first surface and said inner second surface and said lower platform surface defining a slot means therebetween adapted to detachably receive a sink bowl edge therein, said slot means defining two open side areas therein; and (d) a removable covering means being of a water-resistant plastic material extending into said slot means between the sink bowl edge and said lower platform surface, said inner first surface and said second surface to prevent water in the sink from wetting the flexible resilient material to said platform means and said first and second leg means, said covering means further including:

1. two upper flaps extending through said open side area between said lower platform surface and the top edge of the sink bowl;
2. a first set of side flaps extending through said open side areas between said inner first surface and the inner portion of a sink bowl edge to be held in place by the bias therebetween;
3. a second set of side flaps extending through said open side area between said inner second surface and the outer portion of a sink bowl edge to be held in place by the bias therebetween;
4. a first lower flap extending vertically upward into said slot means between said inner first surface and said inner portion of a sink bowl edge to be held in place by the bias therebetween; and
5. a second lower flap extending vertically upward into said slot means between said inner second surface and said outer portion of a sink bowl edge to be held in place by the bias therebetween.

* * * * *